US011571598B2

(12) United States Patent
Cargill

(10) Patent No.: US 11,571,598 B2
(45) Date of Patent: Feb. 7, 2023

(54) ADAPTABLE EXERCISE PLATFORM WITH STRENGTH COMPENSATION FEATURES

(71) Applicant: Casey Cargill, Costa Mesa, CA (US)

(72) Inventor: Casey Cargill, Costa Mesa, CA (US)

(73) Assignee: Softworks, LLC, Costa Mesa, CA (US)

( * ) Notice: Subject to any disclaimer, the term of this patent is extended or adjusted under 35 U.S.C. 154(b) by 0 days.

(21) Appl. No.: 15/220,391

(22) Filed: Jul. 27, 2016

(65) Prior Publication Data

US 2018/0028853 A1 Feb. 1, 2018

(51) Int. Cl.

*A63B 21/00* (2006.01)
*A63B 23/00* (2006.01)
*A63B 23/04* (2006.01)

(52) U.S. Cl.

CPC .... *A63B 21/00047* (2013.01); *A63B 21/4035* (2015.10); *A63B 21/4037* (2015.10); *A63B 23/00* (2013.01); *A63B 23/0458* (2013.01); *A63B 2023/006* (2013.01)

(58) Field of Classification Search

CPC ... A63B 6/00; A63B 21/00047; A63B 21/068; A63B 21/4027; A63B 21/4033; A63B 21/4034; A63B 21/4035; A63B 21/4037; A63B 21/4039; A63B 23/00; A63B 23/0458; A63B 2023/006; A63B 71/0009; A63B 2208/0204; A63B 2208/0209; A63B 2208/0228; A63B 2208/0238; A63B 2208/0242; A63B 2208/0252; A63B 2225/09; A63B 2225/093

See application file for complete search history.

(56) References Cited

U.S. PATENT DOCUMENTS 4,012,799 A * 3/1977 Rutherford ..... A61G 7/103 5/81.1 R
5,066,001 A * 11/1991 Wilkinson ..... A63B 21/4037 482/52
5,154,678 A * 10/1992 Adamczyk ..... A63B 23/0458 482/52
5,158,512 A * 10/1992 Irwin ..... A63B 23/0458 482/52
D353,929 S * 12/1994 Kincaid ..... D34/28
5,672,144 A * 9/1997 Hulme ..... A63B 23/0211 482/91
5,781,954 A * 7/1998 Mayer ..... B66F 7/243 254/88
6,409,634 B1 * 6/2002 Profaci ..... A63B 69/10 434/254
9,433,813 B1 * 9/2016 Cervantez ..... A63B 21/00047
D783,923 S * 4/2017 Bernart ..... A61G 7/103 D34/32
D793,024 S * 7/2017 Bernart ..... D34/32
2005/0101444 A1 * 5/2005 Dadbeh ..... A63B 23/10 482/52

(Continued)

*Primary Examiner* — Gary D Urbiel Goldner

(57) ABSTRACT

An adaptable exercise apparatus for assisting individuals with reduced physical abilities, whether due to injury or age, perform a range of low impact exercises and stretches to the best of their ability given their physical condition. The apparatus comprises a plurality of ergonomically shaped stackable exercise platforms allowing for variable height adjustment and a variety of strength compensating features specially adapted to integrate with the stackable exercise platforms and assist the performance of the individuals.

12 Claims, 11 Drawing Sheets

(56) References Cited

U.S. PATENT DOCUMENTS

2006/0243522 A1* 11/2006 Hart ..... G09F 15/0068
182/63.1
2008/0118671 A1* 5/2008 Bienkiewicz ..... A63B 21/4037
428/12
2009/0247378 A1* 10/2009 Carlesimo ..... A63B 26/00
482/141
2011/0025004 A1* 2/2011 Walkingshaw ..... A61G 1/007
5/628
2012/0233772 A1* 9/2012 Wang ..... A63B 21/4037
5/417
2013/0023392 A1* 1/2013 Glickfield ..... A63B 17/04
482/142
2013/0197403 A1* 8/2013 Sevy ..... A63B 23/0494
601/5
2013/0307231 A1* 11/2013 Allott ..... B62B 13/16
280/18
2014/0087930 A1* 3/2014 Burns ..... A63B 21/00047
482/142
2015/0074924 A1* 3/2015 Bernart ..... B65G 69/30
14/69.5
2016/0199689 A1* 7/2016 Irwin ..... B32B 21/047
482/142

* cited by examiner

ADAPTABLE EXERCISE PLATFORM WITH STRENGTH COMPENSATION FEATURES

FIELD OF THE PRESENT DISCLOSURE

This disclosure relates generally to exercise equipment, and more particularly to an adaptable exercise platform for assisting those with reduced physical abilities, whether due to age or injury, to perform a range of basic exercises and stretches to the best of their ability given their physical condition.

BACKGROUND OF THE RELATED ART

It is well known that low impact resistance training such as the activities included in many yoga routines, as well as simple exercises such as leg-lifts, sit-ups, and step-ups, and stretches are very effective at increasing flexibility, building strength, and generally promoting health, both physically and mentally. This is especially true when individuals commit to a regular or semi-regular routine involving such activities.

One of the most common obstacles to committing to a regular or semi-regular routine of low impact exercises and stretches is the convenience of doing so. The more convenient it is for an individual to engage in such exercise, the more likely an exercise routine will be successfully established. Establishing a regular exercise routine is typically more easily accomplished if the individual has a comfortable surface upon which to exercise. An example of a very typical comfortable surface upon which to exercise is the standard yoga mat. A yoga mat provides both a clean location on the ground or floor and a minimal amount of cushion for comfort.

For many individuals, however, the standard yoga mat is not a convenient or comfortable surface. For example, for individuals with reduced physical abilities because of an injury or due to the natural processes of aging, lowering one's self to the ground or floor may be quit strenuous, painful, or even physically impossible.

For such individuals, a raised exercise surface would provide a much more comfortable and convenient exercising surface and may increase such individual's likelihood of exercising despite their physical limitations or pain. It is especially important for these particular individuals to have a comfortable and convenient exercising surface because it is through the continued exercise despite ones physical limitations and/or pain that many injuries are eventually rehabilitated or mitigated, and it is through continued exercise that those gradually losing strength and flexibility through the natural processes of aging are best able to delay the body's natural decline and extend their ability to remain active and mobile.

The ideal height of a raised exercising surface may vary from individual to individual according to the individual's physical capability or particular injury, and may even vary for the same individual depending on the particular exercise performed; therefore, an ideal exercising surface would be adaptable to the height preference of the exercising individual. There exists a need for a raised exercise surface capable of being adjusted to various heights to meet the various preferences of each exercising individual.

Individuals with reduced physical abilities often compensate for a lack of strength or flexibility in one portion of their body with assistance from another. For example, many such individuals often prefer to use their arms to assist their legs when attempting to sit or stand. Compensating with one's arms can also allow an individual to perform certain exercises that would prove too difficult or strenuous without such assistance and/or allow physically compromised individuals to exercise with more stability and confidence than they would otherwise enjoy. For this reason, there is also a need for an adjustable height exercise surface that includes strength compensation features that allow an individual to compensate for a lack of strength or flexibility in various parts of the body so that simple exercises and stretches can be performed despite an individual's physical deficiencies.

Similarly, many individuals whose physical abilities are reduced to the point of being bed ridden also have the strength to perform some simple exercises and/or stretches if they were provided with a comfortable, convenient exercise space and various strength compensation features. For these individuals, a typical mattress is often too soft to push against to perform limited physical activities and would benefit from a more firm exercise surface with the strength to support their bodies that could rest on top of their mattress so that they could perform exercises without leaving their bed and various strength compensation features could further reduce the strain required to perform low impact exercises such as partial sit-ups and leg lifts and stretches.

The present disclosure distinguishes over the related art providing heretofore unknown advantages as described in the following summary.

SUMMARY OF THE INVENTION

The present disclosure relates to an adaptable exercise platform with various strength compensation features for assisting those with reduced physical abilities, whether due to age or injury, to perform a range of light exercises and stretches to the best of their ability given their physical condition.

Many existing exercise devices are designed for individuals of average or above average strength and flexibility. However, it is those individuals with more limited strength and flexibility that have a greater need for special equipment designed to assist their exercise needs. Individuals who have been injured or who are gradually losing their strength and flexibility due to the natural process of aging may have great difficulty and may even experience pain when attempting to use standard exercise equipment or when attempting to sit down on the ground or floor to perform exercises on a standard yoga mat. Still others may be capable reaching the ground or floor with ease but worry that they may not be able to stand back up again after exercising.

Similarly, some individuals may not be able to complete a full sit-up without some form of additional assistance and/or may not feel safe or comfortable stepping up on an exercise platform without extra stability provided by something to grab with their hands. However, it is critically important that such individuals continue to engage in light exercise within their physical capabilities so that they may rehabilitate their injuries and/or abate the losses associated with the natural processes of aging.

The present disclosure addresses these special concerns. The present disclosure is a highly adaptable exercise apparatus designed to provide support, convenience, and leverage through strength compensation features in the manner much needed by individuals of more limited physical capability.

In its most basic form, the present disclosure comprises at least one stackable exercise platform of sufficient length to extend from an individual's knees to past their head (when the individual is laying supine on the exercise platform) and of a width greater than the width of an individual's shoulders. The exercise platform's thickness is such that a small plurality of vertically stacked exercise platforms (between 3 and 6) should reach the height of an individual's knees when standing erect. In more precise units this translates to a length in the range of three to four feet, a width in the range of two to three feet, and a thickness in the range of two to six inches. Some embodiments may exhibit greater length so that an individual supine supported by the platform from head to toe.

The exercise platform is constructed from a sturdy, firm material so that it can support an individual's weight without bending or collapsing but it is also able to provide a small amount of flex or cushion for comfort. In some embodiments, the exercise platform may be constructed from two or more different materials to achieve these duel physical characteristics. Some embodiments may feature a composite construction including structural stringers and foam to provide the requisite structural integrity as well as flex or cushion for comfort.

The lateral edges of each stackable exercise platform are turned upwards and rounded in an ergonomic fashion forming a handrail that runs the length of the lateral edges of the exercise platform so that an exercising individual has many convenient locations to grip the exercise platform while performing an exercise and/or while changing their body's position relative to the exercise platform, such as when changing to a sitting position from a supine position or changing from sitting position to a standing position.

The lateral hand rails also serve as a secure coupling mechanism to vertically affix multiple stackable exercise platforms together. More specifically, the superior surface of each stackable exercise platform is complimentary in shape to the inferior surface of the stackable exercise platforms placed immediately above. In this manner, the exercising individual may adapt the exercising platform to whatever height they desire simply by securely stacking the appropriate number of stackable exercise platforms. This feature provides the benefit of creating a sturdy elevated exercise platform for individuals who may have difficulty or experience pain when attempting to sit on the ground or floor.

Some individuals may only utilize one exercise platform or stack only a few exercise platforms to create an exercise platform that is only slighted elevated from the ground or floor while others may stack several exercise platforms so that they may sit down on the exercise platform by merely bending their knees slightly. Some embodiments may include a top stackable platform with a flat surface without the raised handrails for the performance of exercises in which such handrail might interfere.

The presently disclosed apparatus may also include a variety of strength compensation features to assist individuals perform light exercises. For example, some embodiments include a wedge shaped accessory component for supporting the individual's upper torso in a partially up-right position when the individual is lying on the exercise platform. This may be used for many different exercises including but not limited to performing partial sit-ups without fully extending to the supine position.

Another strength compensation feature is a shortened exercise platform component. The shortened exercise platform component may have the same width and complimentary inferior surface as the standard stackable exercise platform to enable coupling but its length is reduced relative to the standard stackable exercise platform. This accessory component may be used to elevate the hips higher than the shoulder blades when laying supine on an exercise platform coupled with this accessory component. Such a position may assist in the performance of a wide variety of light exercises and stretches.

One further strength compensation feature is the roller accessory component. The roller accessory component extends the width of the stackable exercise platform with terminal ends designed to comport with and be guided by the stackable exercise platform's lateral handrails. This accessory component is designed to allow an individual to lay supine on the stackable exercise platform with the roller underneath the individual perpendicularly across the center of the individual's back. As the exercising individual pushes their body lengthwise along the exercise platform, the roller rolls along the exercise platform guided by the exercise platform's lateral handrails applying pressure to the individual's spine and surrounding muscles. This therapy itself it not new, but an apparatus that allows the therapy to be performed at a custom elevation for individuals with limited physical capacity is quite novel.

A still further strength compensation feature is the mobility assistance frame. The mobility assistance frame is an accessory component constructed from lightweight aluminum bars or similar material designed for the purpose of providing a stable support structure to grip with one's hands to gain additional stability and/or leverage while performing various exercises. The mobility assistance frame is situated with one or more base legs on either side of the stackable exercise platform and is height adjustable thereby providing the individual with a stable structure within arm's reach regardless of the height at which such individual has adjusted the exercise platform. In some embodiments the mobility assistance frame also includes a trapeze-style bar suspended over the exercising platform allowing the individual an additional structure to grip for the purpose of assisting in the performance of light exercises or stretches.

Other embodiments of the present disclosure may include additional strength compensating features designed to further assist individuals with diminished physical capabilities perform light exercises and stretches.

This disclosure teaches certain benefits in construction and use which give rise to the objectives described below:

A primary objective is to provide a more convenient exercise and stretching surface for those with limited strength or range of motion;

Another objective is to provide an exercise platform of an adjustable height for those individuals who experience great difficulty and/or suffer from pain when attempting to sit down on the ground or floor;

A further objective is to encourage individuals with limited physical capacity, whether due to injury or the natural processes of aging, to perform light exercises and stretches within their abilities;

Other features and advantages of the present invention will become apparent from the following more detailed description, taken in conjunction with the accompanying drawings, which illustrates, by way of example, the principles of the presently described apparatus and method of use.

BRIEF DESCRIPTION OF THE DRAWING(S)

The accompanying drawings are diagrams that illustrate various exemplary implementations and are part of the specification. The illustrated implementations are proffered for purposes of example, not for purposes of limitation. Illustrated elements will be designated by numbers. Once designated, an element will be identified by the identical number throughout. Illustrated in the accompanying diagram drawings is at least one of the best mode embodiments of the present disclosure. In such drawings.

Figure 16:
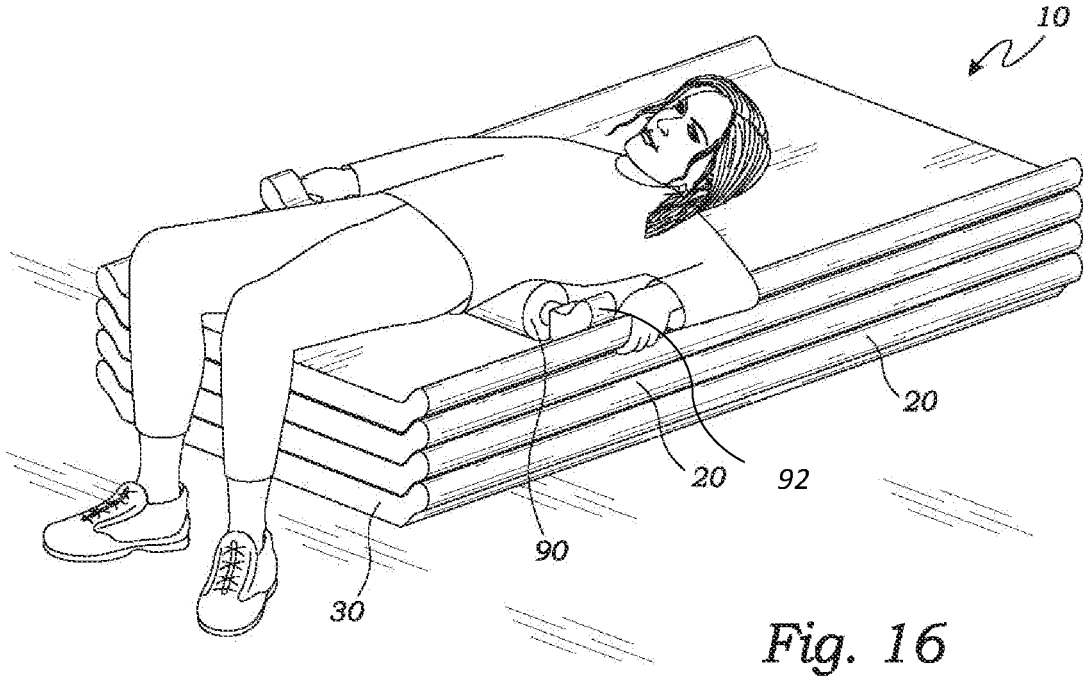
Figure 17:
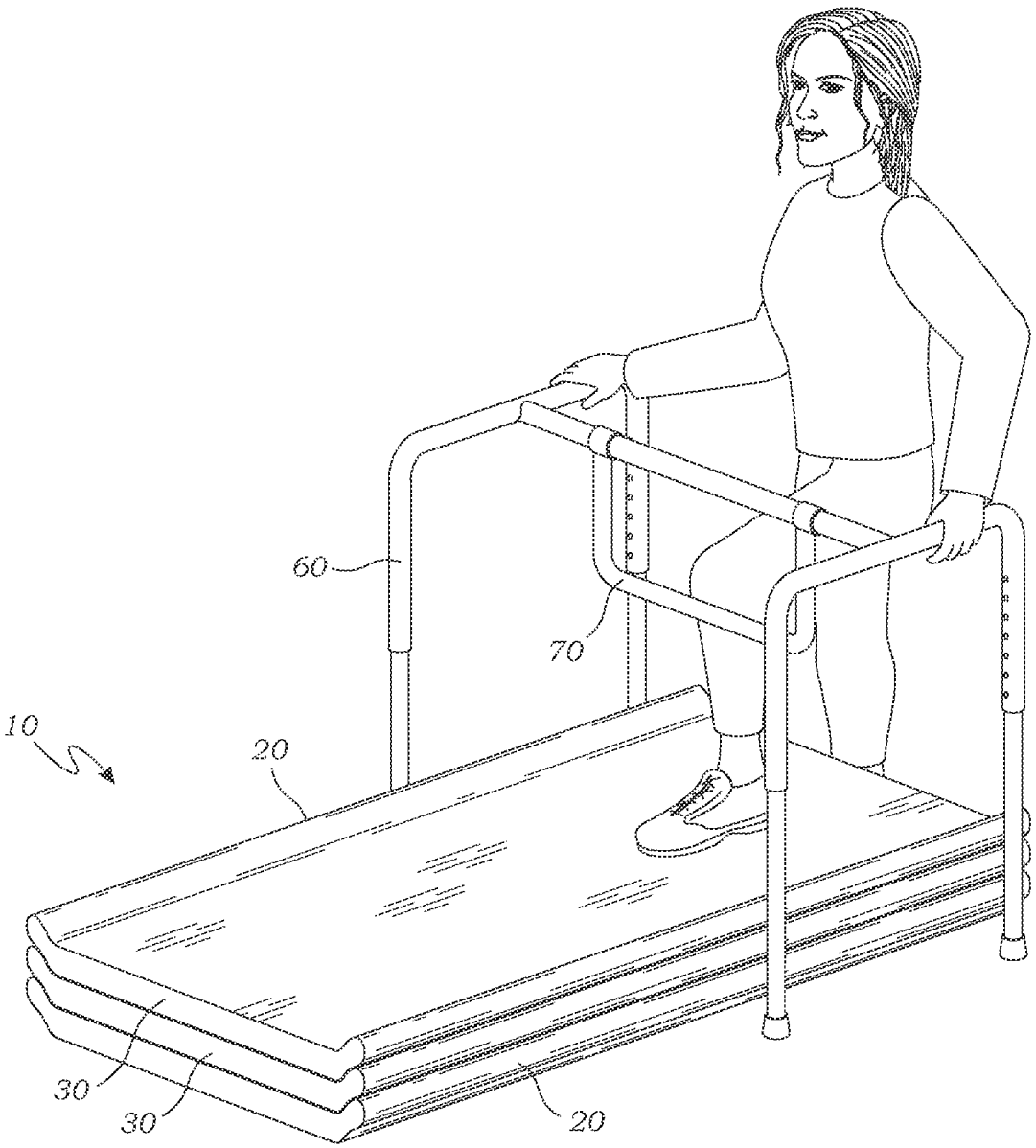
Figure 18:
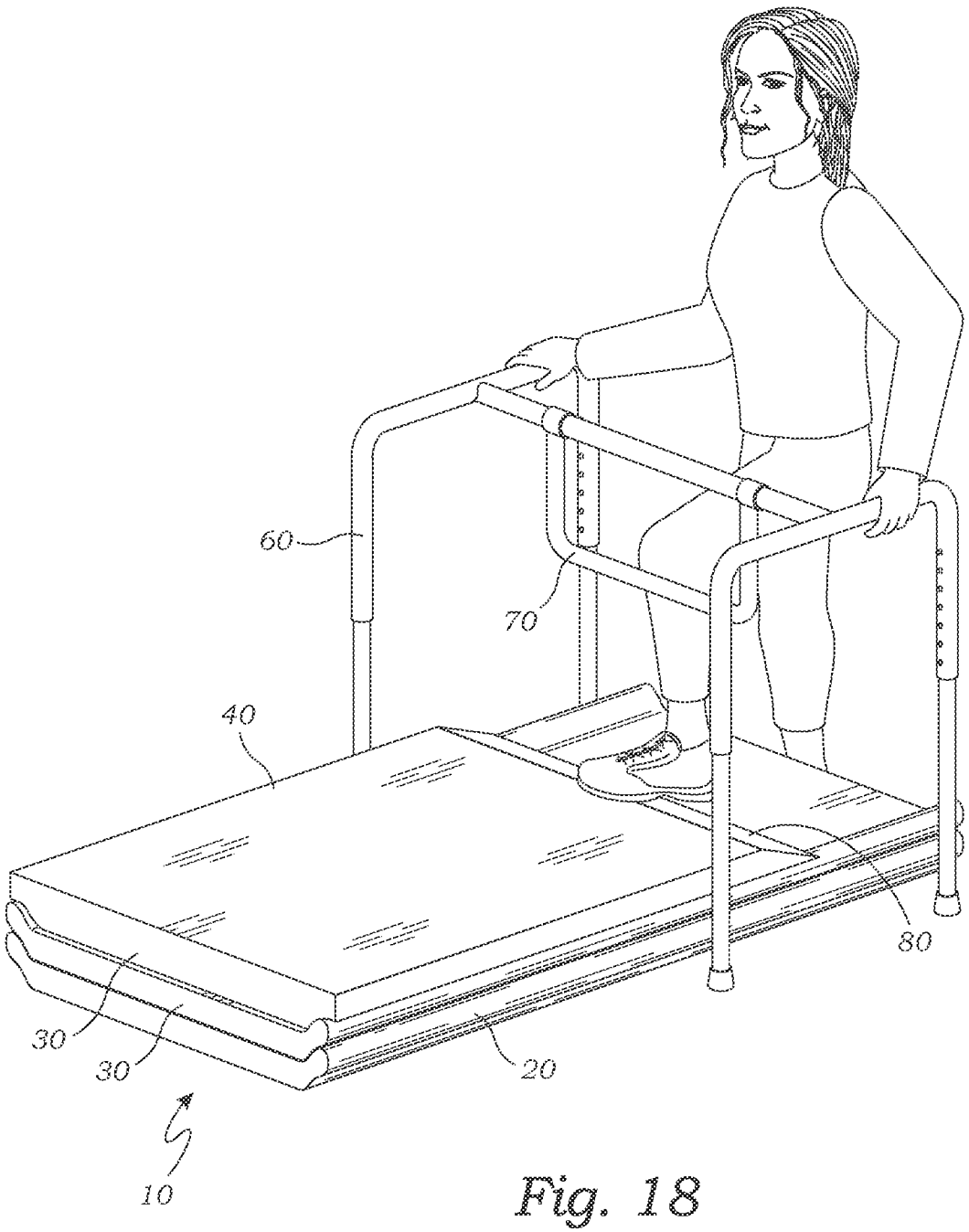
Figure 19:
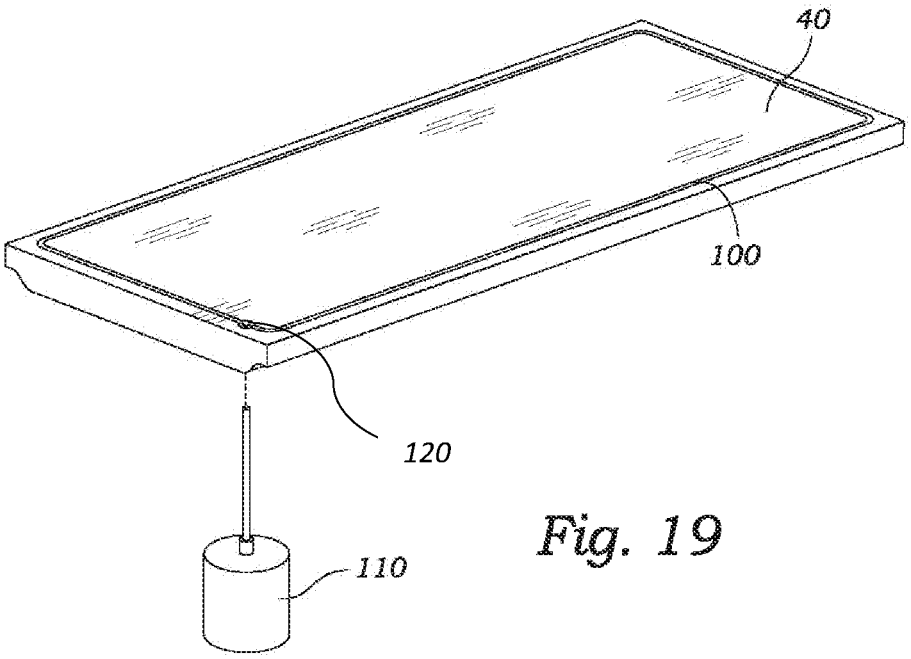
Figure 20:
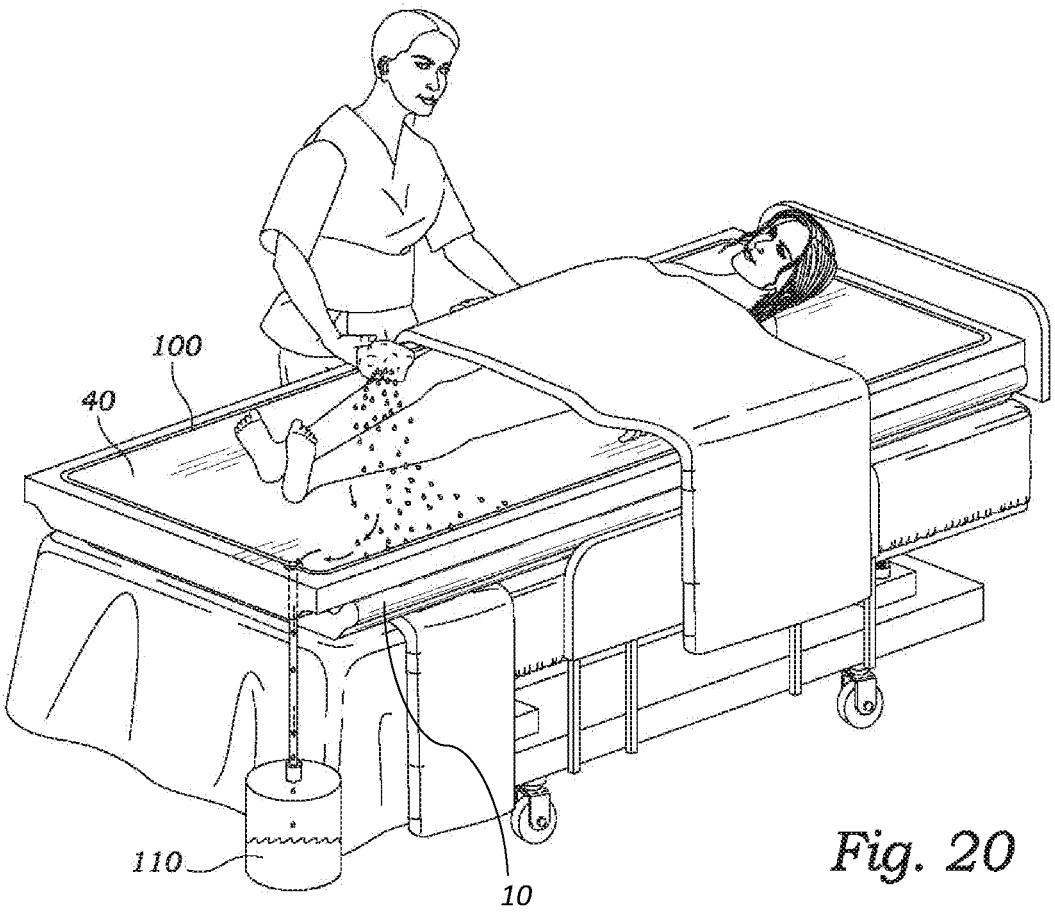

FIG. 16 is a perspective view of an exemplary embodiment of the presently disclosed apparatus illustrated with an individual laying supine on four coupled exercise platforms also featuring a roller accessory component guided by the lateral hand rails for the purpose of allowing an individual to lay supine with the roller perpendicularly across the center of the individual's back applying pressure to the spine and surrounding muscles as the exercising individual pushes their body lengthwise across the coupled exercise platforms;

FIG. 17 is a perspective view of an exemplary embodiment of the presently disclosed apparatus illustrated with an individual performing a step exercise using three coupled exercises platforms to form step of the desired height also featuring a strength compensation feature, namely, a mobility assistance frame to provide additional stability;

FIG. 18 is a perspective view of an exemplary embodiment of the presently disclosed apparatus illustrated with an individual performing a step exercise using three coupled exercises platforms to form step of the desired height with the top coupled exercises platform featuring a shortened length and an inclined edge to facilitate calf stretching, also featuring a strength compensation feature, namely, a mobility assistance frame to provide additional stability;

FIG. 19 is a perspective view of an exemplary embodiment of the presently disclosed apparatus featuring a single exercise platform with a flat surface circumscribed by a drainage duct directed to a collection basin to facilitate the capture and removal of water from a post-exercise sponge bath for individuals with severely limited strength or range of motion;

FIG. 20 is a perspective view of an exemplary embodiment of the presently disclosed apparatus illustrated with an individual laying supine and receiving a post-exercise sponge bath on a single exercise platform with a flat surface circumscribed by a drainage duct directed to a collection basin to facilitate the capture and removal of water;

DETAILED DESCRIPTION OF DRAWINGS OF AN EXEMPLARY EMBODIMENT

The above described drawings illustrate an exemplary embodiment of an apparatus in at least one of its preferred, best mode embodiments, which is further defined in detail in the following description. Those having ordinary skill in the art may be able to make alterations and modifications to what is described herein without departing from the spirit and scope of the disclosure. Therefore, it must be understood that what is illustrated is set forth only for the purposes of example, and that it should not be taken as a limitation of the scope of the present apparatus or its method of use.

Described now in detail is the presently disclosed apparatus and method of use.

Figure 1:
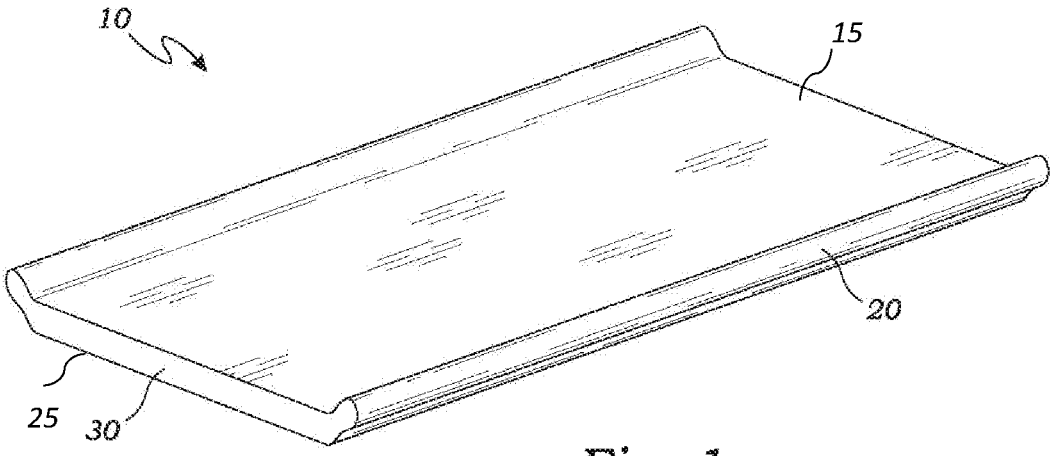
FIG. 1 is an perspective view of an exemplary embodiment of the presently disclosed apparatus featuring a single stackable exercise platform.

FIG. 1 is an illustration of an exemplary embodiment of an elevated exercise platform 10 with upturned lateral edges or side rails 20 serving as ergonomically shaped gripping points. The platform 10 may include a superior surface 15 (or top surface) and an inferior surface 25 (or bottom surface).

The illustrated embodiment features and flat terminal ends 30. In some aspects, the flat terminal ends 30 may include a proximal flat terminal end 30 and a distal flat terminal end 30, as shown in FIG. 1. It is possible for the terminal ends 30 to be shaped differently (for example rounded or inclined) for various aesthetic or functional reasons. In further aspects, the upturned lateral edges or side rails 20 extend between the proximal flat terminal end 30 and the distal flat terminal end 30. In some aspects, the lateral edges or side rails 20 may be disposed perpendicular between the proximal flat terminal end 30 and the distal flat terminal end 30.

The exercise platform 10 should be exhibit some cushion so that it provides comfort to an individual while performing light exercises and stretches but it should also be stiff enough to support the weight of an individual at elevation without significant deformation. To accomplish this, some embodiments are constructed from multiple materials of varying stiffness in various orientations.

FIG. 1 also depicts the general dimensions of the apparatus 10 with a thickness between two (2) and six (6) inches, a width between two (2) and three (3) feet, and a length between three (3) and four (4) feet. These dimensional ranges are based on the dimensional range of average sized individuals. It is possible that the presently disclosed apparatus 10 may be enlarged or reduced outside of these ranges to accommodate exceptionally large or small individuals. For example, the length of some embodiments may be extended to so that an individual may lay supine on the apparatus 10 fully supported by the apparatus 10 from head to toe.

Figure 2:
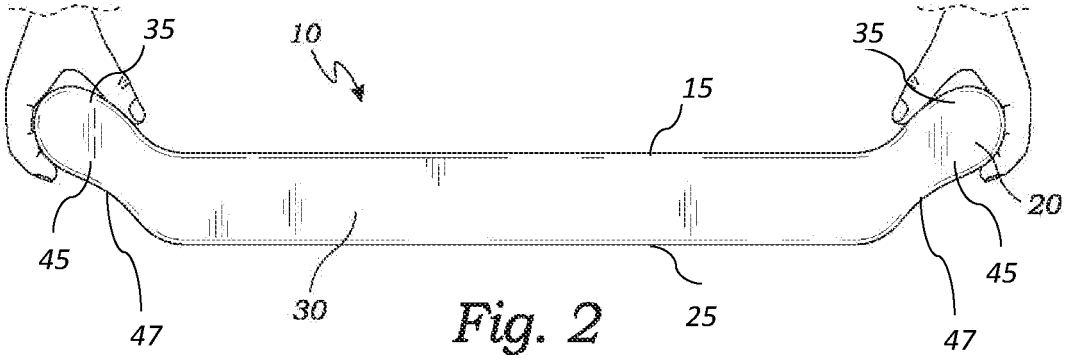
FIG. 2 is an end plan view of an exemplary embodiment of the presently disclosed apparatus illustrated with a pair of hands griping the ergonomically shaped rails of a single stackable exercise platform that serve both as a griping point and a coupling feature.

FIG. 2 depicts an end plan view of the presently disclosed apparatus 10 illustrated with a set of hands gripping the upturned lateral edges side edges serving as handrails 20. The upturned lateral edges or handrails 20 provide a multitude on convenient points to grip the presently disclosed apparatus when getting up or down from the apparatus or when performing certain stretches or exercises.

In some aspects, the upturned lateral edges or handrails 20 may include a first rounded handrail portion 35 and a second rounded handrail portion 45. In one or more aspects, the first rounded handrail portion 35 may be connected to the superior surface 15, and the second rounded handrail portion 45 may be connected to the inferior surface 25. In other words, the first rounded handrail portion 35 and the second rounded handrail portion 45 may be an extension of the superior surface 15 and the inferior surface 25.

In some aspects, the first rounded handrail portion 35 and the second rounded handrail portion 45 may be integrated, and shown in FIG. 2. In other words, the first rounded handrail portion 35 and the second rounded handrail portion 45 may be unitary structure. In one or more aspects, the first rounded handrail portion 35 and the second rounded handrail portion 45 may from a "U-shaped" handrail. As shown in FIG. 2, a length of the second rounded handrail portion 45 may be greater than a length of the first rounded handrail portion 35.

Further, as shown in FIG. 2, the second rounded handrail portion 45 may be curved, as shown by a curve 47. A radius of the curve 47 may be greater than a radius of the "U-shaped" handrail formed by the first rounded handrail portion 35 and the second rounded handrail portion 45. Further, as shown in FIG. 2, an axis of the curve 47 may be perpendicular to a longitudinal axis of the "U-shaped" handrail.

Figure 3:
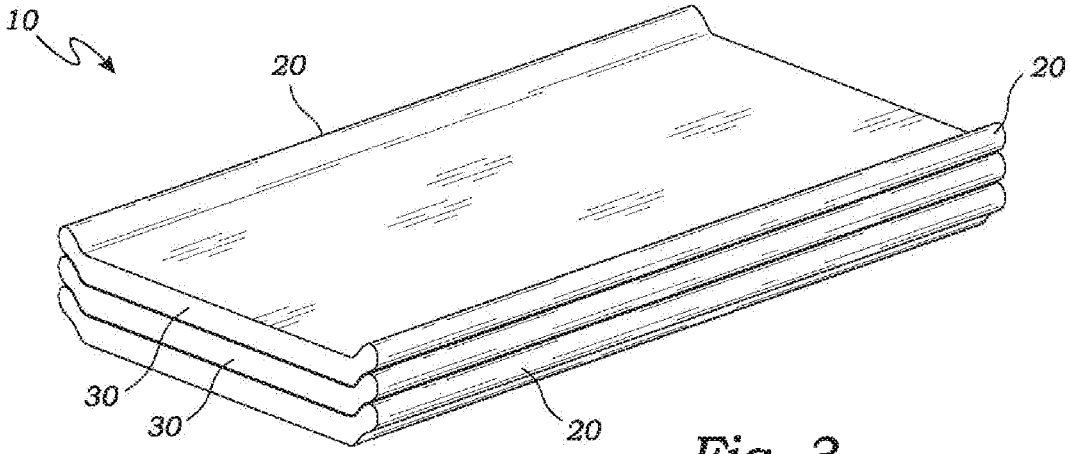
FIG. 3 is a perspective view of an exemplary embodiment of the presently disclosed apparatus featuring three coupled stackable exercise platforms to raise the height of the superior most exercising surface.

FIG. 3 depicts the presently disclosed apparatus 10 placed in vertical adjacency with two other exercise platforms 10. In some aspects, the two other exercise platforms 10 are same as the exercise platform 10 described in conjunction with FIG. 1 and FIG. 2. The superior and inferior surfaces 15, 25 of each exercise platform 10 are complimentary in shape and may be stacked providing a comfortable exercise platform 10 at whatever elevation is best suited for the individual. The upturned lateral edges 20 serves to provide secure coupling ensuring that stacked exercise platforms 10 act as one unit without slippage.

As shown in FIG. 3, the multiple exercise platforms 10 (top exercise platform, middle exercise platform, and third exercise platform) may completely overlap in the stacked position. In other words, the upturned lateral edges 20 of each platform may be placed one over another, which provides secure coupling. Similarly, the flat terminal ends 30 of each platform may be placed one over another, which provides secure coupling. In particular, the superior surface 15 of the bottom exercise platform may contact the inferior surface 25 of the middle exercise platform. Further, the first rounded handrail portion 35 of the bottom exercise platform may contact the second rounded handrail portion 45 of the middle exercise platform.

Figure 4:
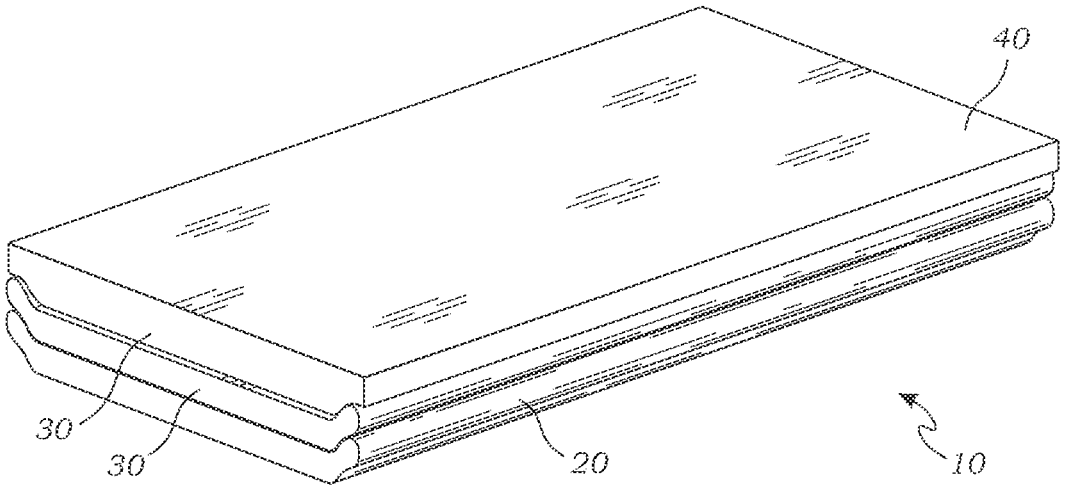
FIG. 4 is a perspective view of an exemplary embodiment of the presently disclosed apparatus featuring three coupled stackable exercise platforms with a superior most stackable platform featuring a flat superior surface without the raised handrails for the purpose of performance of exercises or stretches in which such handrail might interfere.

FIG. 4 depicts the presently disclosed apparatus 10 with a top stackable exercise platform without upturned lateral edges forming handrails 40. The "flat-topped" exercise platform 40 is still stackable because the inferior surface of the flat-topped exercise platform 40 is complimentary in shape to the superior surface of the standard-shaped exercise platforms 10 that do feature upturned lateral edges 20. In some aspects as shown in FIG. 4, the length and width of the "flat-topped" exercise platform 40 may be same as length and width of the stackable exercise platform 10.

In some aspects, the interior surface of the flat-topped exercise platform 40 may have curved lateral edges along a longitudinal axis of the flat-topped exercise platform 40 that are placed over the upturned lateral edges 20 (and specifically over the first rounded handrail portions 35) of the stackable exercise platform 10. In one or more aspects, the curved lateral edges of the flat-topped exercise platform 40 may correspond in shape to the first rounded handrail portions 35. The flat-topped exercise platform 40 may be utilized at the superior most stackable exercise platform 10 when individuals are performing light exercises or stretches in which the upturned lateral edges 20 may be in the way or obstruct the stretching or exercising experience.

Figure 5:
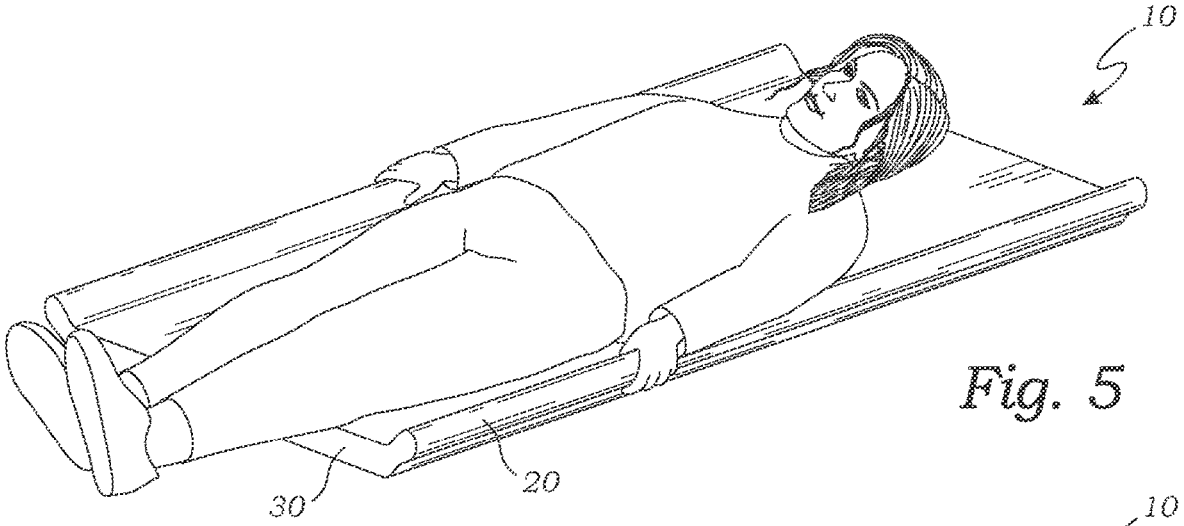
FIG. 5 is a perspective view of an exemplary embodiment of the presently disclosed apparatus illustrated with an individual laying supine on a single stackable exercise platform shown griping the ergonomic lateral hand rails.
Figure 6:
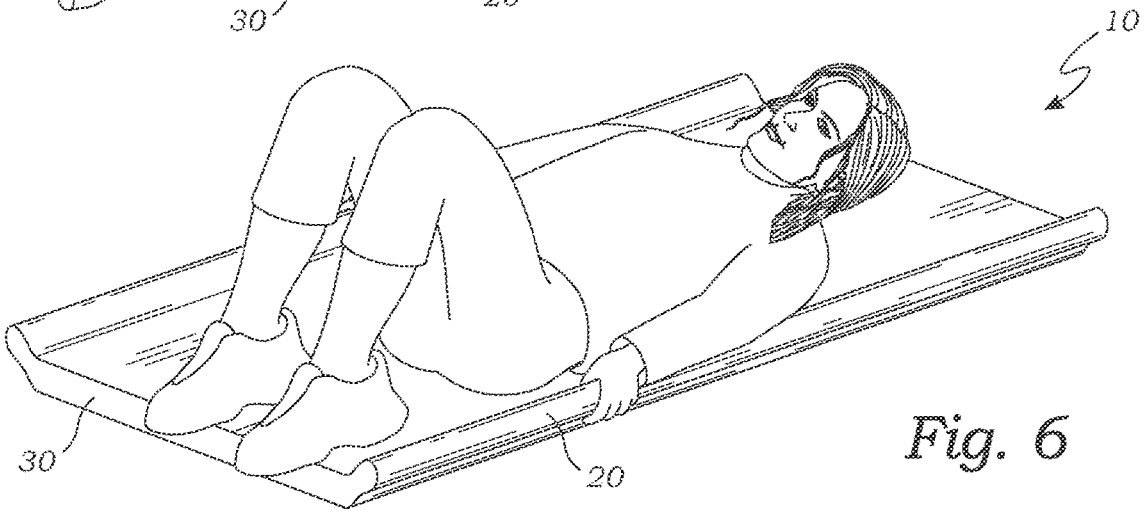
FIG. 6 is a perspective view of an exemplary embodiment of the presently disclosed apparatus illustrated with an individual laying supine with knees bent on a single stackable exercise platform shown griping the ergonomic lateral hand rails.
Figure 7:
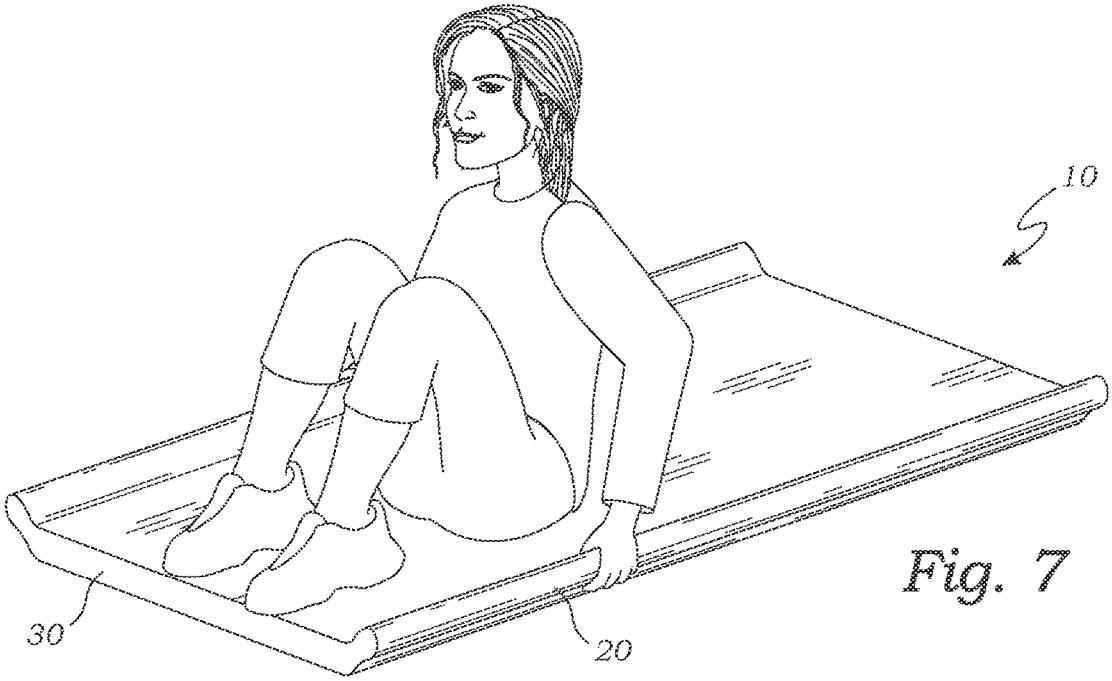
FIG. 7 is a perspective view of an exemplary embodiment of the presently disclosed apparatus illustrated with an individual sitting upright with knees bent on a single stackable exercise platform shown griping the ergonomic lateral hand rails.

FIGS. 5, 6, and 7 depict an exemplary embodiments of a single stackable exercise platforms 10 illustrated with an individual performing various exercises and/or stretches while gripping the upturned lateral edges as ergonomic handrails 20. These illustrations demonstrate both the utility of the upturned lateral handrails 20 and how a single stackable exercise platform 10 may be utilized to provide a comfortable and slightly elevated comfortable exercise surface.

Figure 8:
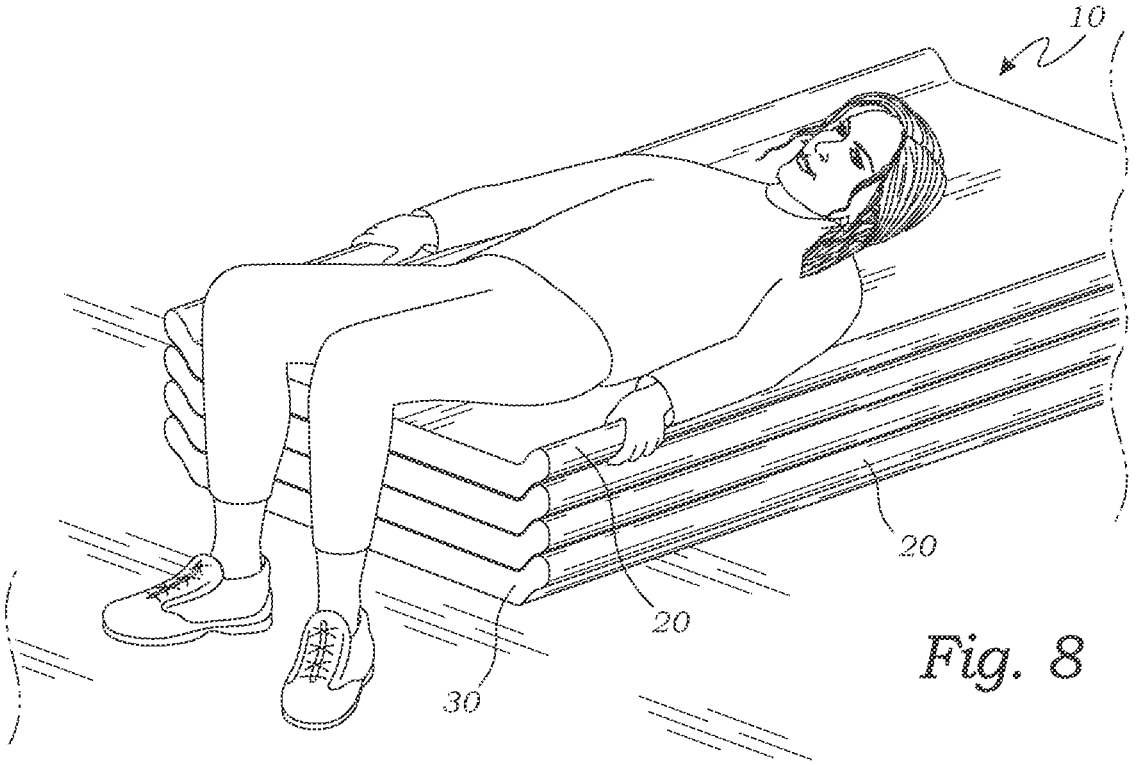
FIG. 8 is a perspective view of an exemplary embodiment of the presently disclosed apparatus illustrated with an individual laying supine on four coupled stackable exercise platforms shown laying supine with knees bent and feet placed firmly on the ground and hands griping the ergonomic lateral hand rails.
Figure 9:
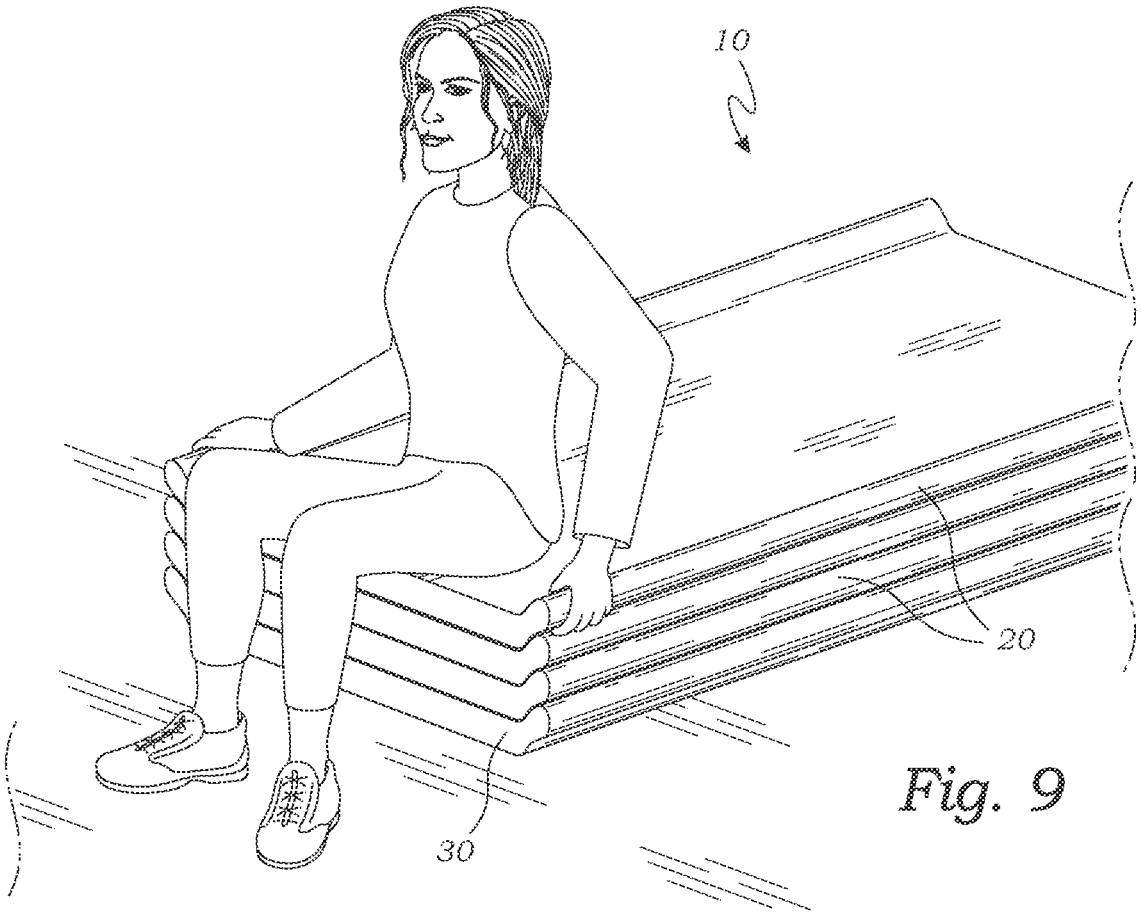
FIG. 9 is perspective view of an exemplary embodiment of the presently disclosed apparatus illustrated with an individual sitting upright on four coupled stackable exercise platforms shown with knees bent and feet placed firmly on the ground and hands griping the ergonomic lateral hand rails.

FIGS. 8 and 9 depict an exemplary embodiment of multiple securely coupled stackable exercise platforms 10 illustrated with an individual performing various exercises and/or stretches while gripping the upturned lateral edges as ergonomic handrails 20. By utilizing multiple securely coupled stackable exercise platforms 10 an individual can created a comfortable exercising surface at whatever elevation best accommodates the individuals strength, injury, or the particular stretch and/or exercise the individual is interested in performing. As previously mentioned, one of the most important factors in determining whether an individual will continue to engage in a regular exercise and/or stretching regimen is whether or not the individual has a comfortable exercising surface available, with the adaptability of the presently disclosed apparatus, the individual may customize the elevation of the exercise surface thereby ensuring maximum possible comfort.

Figure 10:
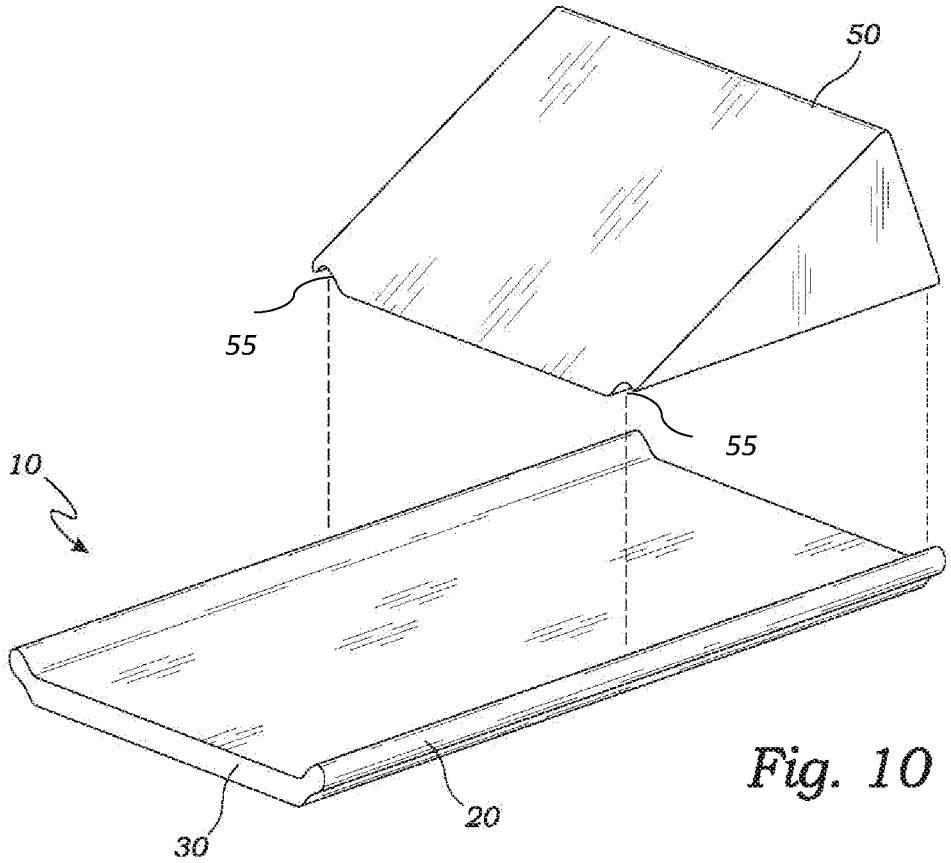
FIG. 10 is blown-up a perspective view of an exemplary embodiment of the presently disclosed apparatus featuring a single exercise platform and a strength compensation feature, namely, an angled support wedge accessory component.
Figure 11:
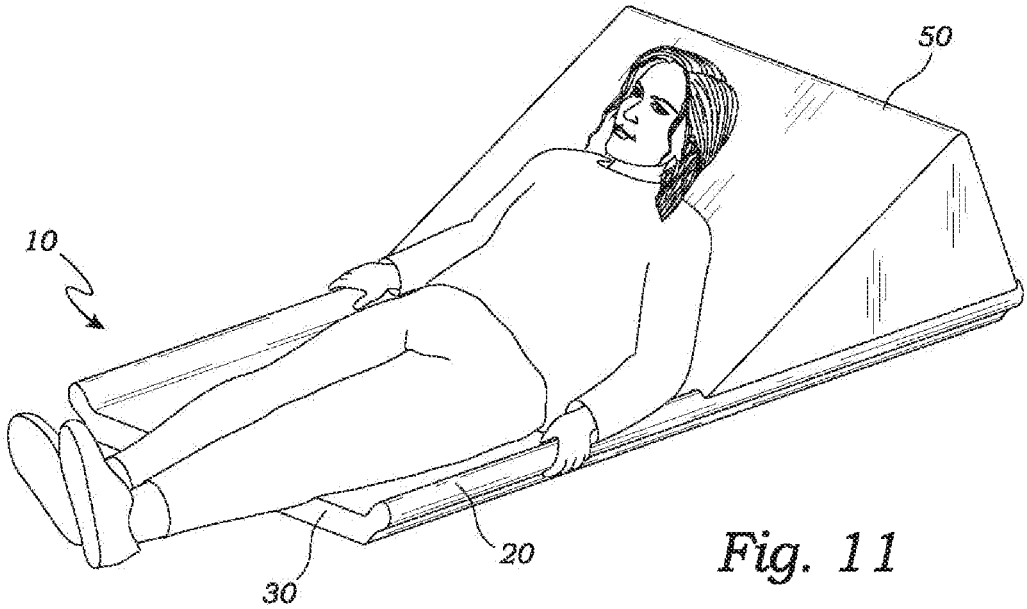
FIG. 11 is a perspective view of an exemplary embodiment of the presently disclosed apparatus illustrated with an individual laying supine on a single exercise platform with their upper torso propped up by a strength compensation feature, namely, an coupled angled support wedge accessory component.

FIGS. 10 and 11 illustrates an exemplary embodiment that includes a wedge-shaped accessory component 50. In FIG. 10 the wedge shape accessory component 50 is blown apart showing that the inferior surface of the wedge-shaped accessory component 50 is complimented in shape to the superior surface of the stackable exercise platform 10 thereby enabling secure coupling. The wedge shape accessory component 50 may have the same width as that of the stackable exercise platform 10.

In some aspects, the wedge shape accessory component 50 may have curved lateral edges 55 that may be placed over the upturned lateral edges 20 (and specifically over the first rounded handrail portions 35) of the stackable exercise platform 10. In one or more aspects, the curved lateral edges 55 may correspond in shape to the first rounded handrail portions 35. In other words, the curved lateral edges 55 may fit onto the first rounded handrail portion 35.

FIG. 11 illustrates an individual laying on an exemplary embodiment of a stackable exercise platform 10 coupled with a wedge-shaped accessory component 50 such that the individual's torso is propped up at the angle of the wedge. The individual may perform various exercising and stretches more easily or with less strain in this orientation. Wedge-shaped accessory components 50 can be created with a wide variety of wedge angles to fit the preferences of the individual.

Figure 12:
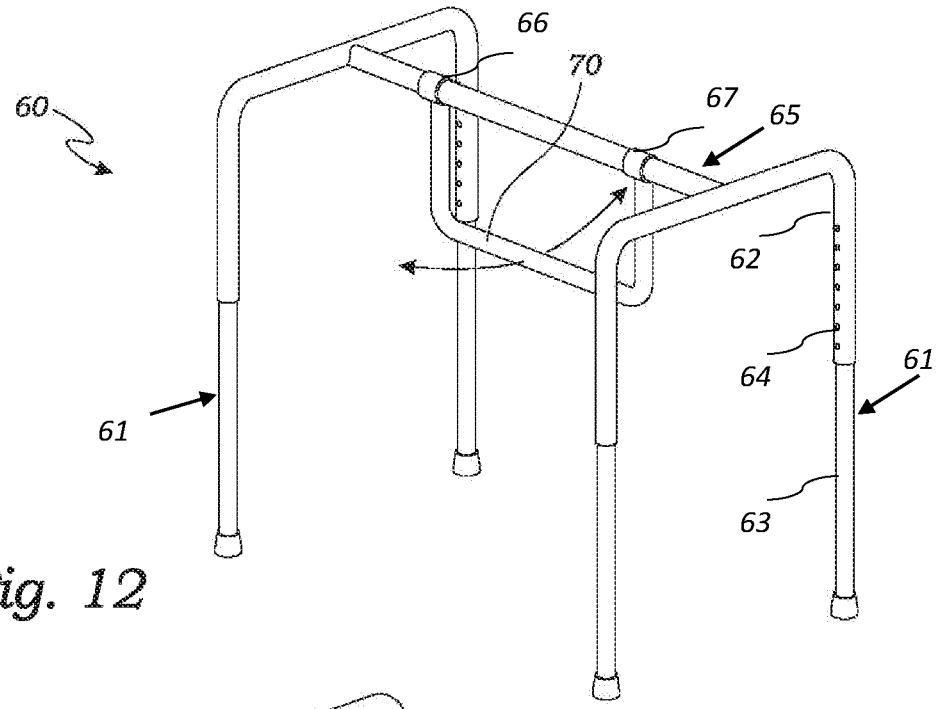
FIG. 12 is a perspective view of an exemplary embodiment of the presently disclosed apparatus featuring a strength compensation feature, namely, a mobility assistance frame with the purpose of providing stability and/or leverage to individuals while performing stretches and exercises.

FIG. 12 depicts and exemplary embodiment of a mobility assistance frame. The mobility assistance frame 60 is a height adjustable structure that provides additional gripping points and balance stability to the exercising and/or stretching individual. In some aspect, the mobility assistance frame 60 may include two vertical members 61 that may be inverted "U-shaped" tubes. The two vertical members 61 have four supporting legs. In some aspects, the each vertical members 61 may include a first vertical tube 62 and a second vertical tube 63. In some aspects, a diameter of the first vertical tube 62 may be greater than a diameter of the second vertical tube 63, as shown in FIG. 12. In further aspects, a portion of the second vertical tube 63 may be inserted in the first vertical tube 62, which enables height adjustment of the mobility assistance frame 60. The position of the first vertical tube 62 and the second vertical tube 63 may be locked by using an interlock mechanism 64. In some aspects, the second vertical tube 63 or the first vertical tube 62 may slide relive to each other to adjust the height of the mobility assistance from 60, and lock against each other by using the interlock mechanism 64.

In further aspects, the mobility assistance frame 60 may include a horizontal member 65 that may be connected between the two vertical member 61. Specifically, the horizontal member 65 may be connected between the horizontal "U-shaped" structure of the two vertical members 61. In some aspects, the horizontal member 65 may be placed perpendicular to the horizontal "U-shaped" structure of the two vertical members 61. In one or more aspects, the horizontal member 65 may be placed at a center position between the horizontal "U-shaped" structure of the two vertical members 61.

In some embodiments the mobility assistance frame 60 includes an additional gripping point in the form of a suspended trapeze-style bar 70. The suspend trapeze-style bar 70 may be suspended on the horizontal member 65 (e.g., in the center of the horizontal member 65). The suspended trapeze-style bar 70 may be "U shaped" having a first bar end 66 and a second bar end 67. The first bar end 66 and the second bar end 67 may be connected to the horizontal member 65 such that the suspended trapeze-style bar 70 may move in a direction as shown in FIG. 12 (e.g., may move forward or backward in a circular arc). In some aspects, the first bar end 66 and the second bar end 67 may include a loop that may hold the horizontal member 65, such that the suspended trapeze-style bar 70 may move in the direction discussed above.

Figure 13:
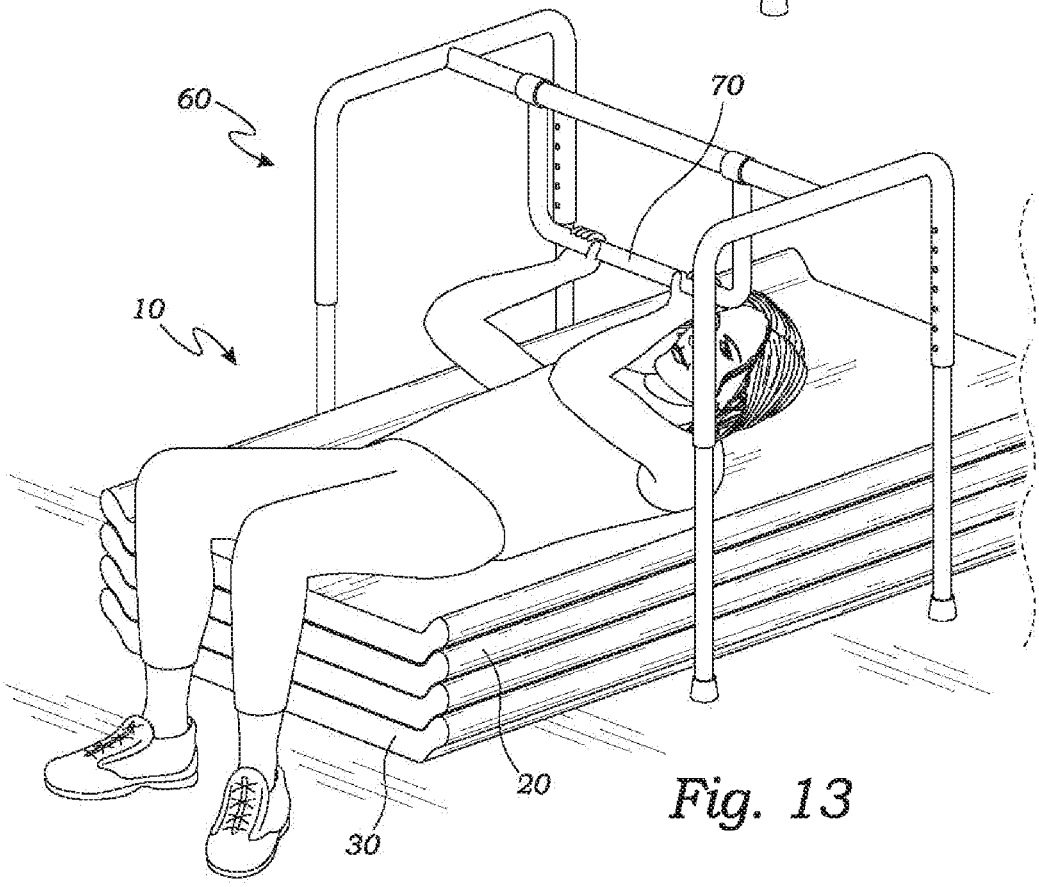
FIG. 13 is a perspective view of an exemplary embodiment of the presently disclosed apparatus illustrated with an individual laying supine on four coupled stackable exercise platforms shown with knees bent and feet on the ground and griping a strength compensation feature, namely, a mobility assistance frame for additional leverage while performing stretches and exercises.

FIG. 13 illustrates an individual laying supine at a custom elevation created by on four securely coupled stackable exercise platforms 10 and gripping a trapeze-style bar 70 suspended from a mobility assistance frame 60. The trapeze-style bar 70 can be adjusted to the preferred height because the mobility assistance frame 60 is height adjustable. With this example orientation, the individual can perform sit-ups using their arms to assist their abdomen. This is just one of many exercise and/or stretch configurations that are possible.

Figure 14:
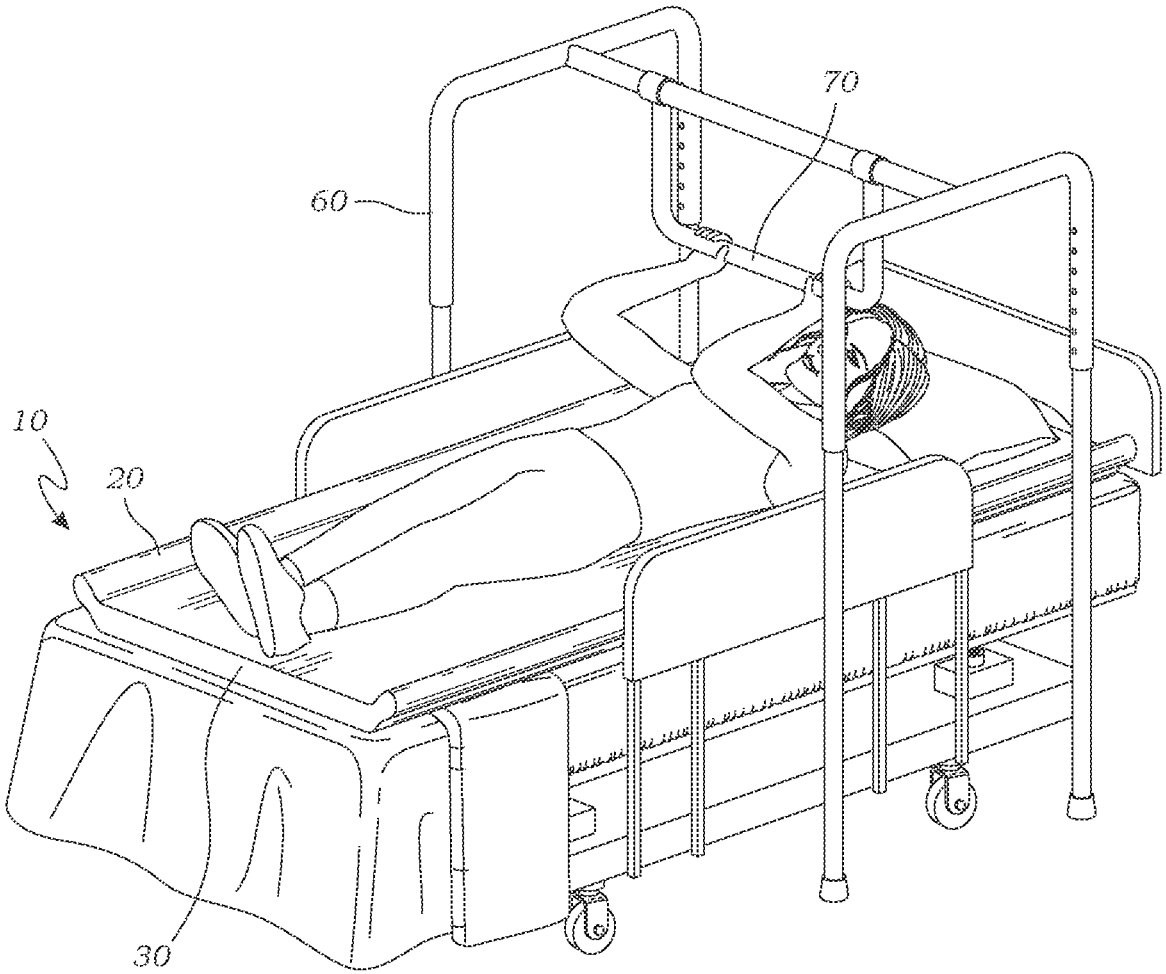
FIG. 14 is a perspective view of an exemplary embodiment of the presently disclosed apparatus illustrated with an individual laying supine on a single exercise platform shown placed on a hospital bed and griping a strength compensation feature, namely, a mobility assistance frame for additional leverage while performing stretches and exercises.

FIG. 14 depicts an embodiment of the present disclosure including a stackable single exercise platform 10 and a mobility assistance frame 60 configured to assist an individual excise while restricted to a hospital bed. This particular embodiment is an extended length version providing support from the individuals head to toe. In other words the length of the exercise platform 10 may correspond to the length of the hospital bed. The exercise platform 10 serves to provide firmness that hospital bed mattress does not and the mobility assistance frame 60 allows the individual to use their arms to exercise and/or stretch to the degree that they are able.

As shown in FIG. 14, the height of the exercise platform 10 may be adjusted such that the individual may hold suspended trapeze-style bar 70 to perform exercise on the hospital bed.

Figure 15:
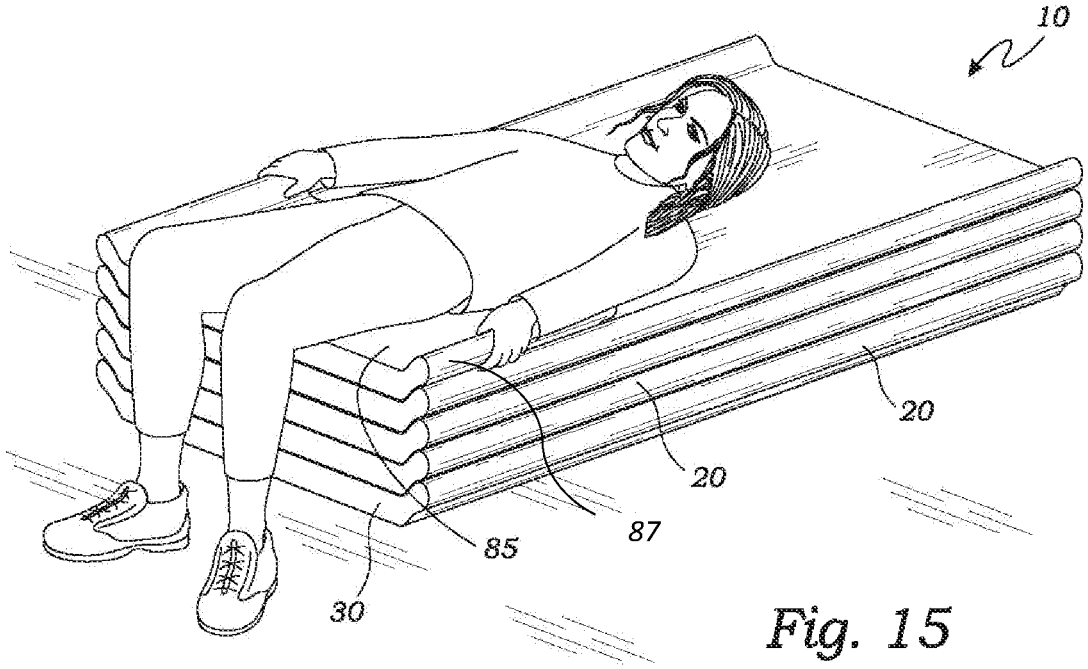
FIG. 15 is a perspective view of an exemplary embodiment of the presently disclosed apparatus illustrated with an individual laying supine on five coupled exercise platforms, the fifth coupled exercise platform featuring a shorted length thereby elevating the individual's hips above the individual's shoulders for particular exercises and stretches.

FIGS. 15 and 16 depict embodiments of the present disclosure that include various addition accessory components. FIG. 15 depicts a shortened stackable exercise platform 85 whereby an individual can prop their hips up higher than their shoulders. In some aspects, the shortened stackable exercise platform 85 may have length less than half the length of the stackable exercise platform 10. Further, the shortened stackable exercise platform 85 may have same width as the width of the stackable exercise platform 10.

In further aspects, the shortened stackable exercise platform 85 may include upturned lateral side edges servings handrails 87. The handrails 87 may be same as the handrails 20 (corresponding to the stackable exercise platform 10) described in conjunction with above figures. In other words, the lateral side edges of the shortened stackable exercise platform 85 may be turned upwards and rounded in an ergonomic fashion forming handrails 87 running along the length of the shortened stackable exercise platform 85. In some aspects, the bandrails 87 may be place over the handrails 20. In further aspects, a flat terminal end corresponding to the shorten stackable exercise platform 85 may be placed over the proximal flat terminal end 30 or the distal flat terminal end 30.

In further aspects, the shortened stackable exercise platforming 85 may have an inferior surface that is complimentary in shape to the superior surface 15 of the stackable exercise platform 10 allowing for secure coupling of said shortened stackable exercise platform 85 to the stackable exercise platform 10 when placed in vertical adjacency.

FIG. 16 depicts a cylindrical roller accessory component 90 with terminal ends that are shaped to accommodate the upturned lateral edges 20 of the stackable exercise platform 10 whereby an individual may lay supine on a stackable exercise platform 10 and pushes their body perpendicularly across the cylindrical roller accessory component 90 applying pressure on the individual's spine and surrounding muscles.

In some aspects, the cylindrical roller accessory component 90 may have a width that may be similar (or slightly smaller) as the width of the superior surface 15 or the interior surface 25 of the stackable exercise platform 10. In further aspects, the cylindrical roller accessory component 90 may be attached to upturned lateral side edges of the cylindrical roller accessory component 90 serving as handrails 92. In some aspects, the cylindrical roller accessory component 90 and the handrails 92 may form a unitary structure.

FIG. 17 depicts an individual using a mobility assistance frame 60 to provide extra stability support while performing step exercises on a plurality of stackable exercise platforms 10. In some aspects, the individual may take support of the vertical members 61 to perform the exercise.

FIG. 18 depicts an individual using a shortened flat-topped stackable exercise platform with a declined angle terminal end 80. This accessory component provides an individual with a declined angle on which to stretch their calf muscles. In particular, as shown in FIG. 18, the length of the shortened flat-topped stackable exercise platform may be more than half of the length of the stackable exercise platform 10. In some aspects, the width of the shortened flat-topped stackable exercise platform may be same as the width of the stackable exercise platform 10.

In some aspects, the inferior surface of the shortened flat-topped stackable exercise platform may have curved lateral edges that may be placed over the upturned lateral edges 20 (and specifically over the first rounded handrail portions 35) of the stackable exercise platform 10. In some aspects, the shortened flat-topped stackable exercise platform may have two curved lateral edges. In one or more aspects, the curved lateral edges may correspond to the shape of the first rounded handrail portion 35.

FIGS. 19 and 20 depicts and embodiment that is particularly adapted to individuals who are restricted to hospital beds. This particular embodiment includes a drainage duct 100 that circumscribes the exercise platform so that after exercising, a nurse may give the bed restricted individual a sponge bath on the exercise platform 10 and the runoff water will collected in the drainage duct 100 and then directed and captured in a collection basin 110. This embodiment may be used in conjunction with exercising to both assist in the post exercise showering and rising process and to preserve the freshness of the individuals bedding.

In particular, FIG. 19 and FIG. 20 describes a flat-topped exercise platform 40 (as described in conjunction with FIG. 4). The flat-topped exercise platform 40 may have curved lateral edges that may be placed over the upturned lateral edges 20 (and specifically over the first rounded handrail portions 35) of the stackable exercise platform 10. In one or more aspect, the curved lateral edges may correspond to the shape of the first round handrail portions 35. For example, two lateral edges of the flat-topped exercise platform 40 may be curve corresponding to the shape of the first rounded handrail portion 35.

In some aspects, the flat-topped exercise platform 40 may have duct 100 near the four edges of the flat-topped exercise platform 40. In some aspects, the flat-topped exercise platform 40 may be rectangular in shape, and the duct may also be rectangular in shape. In further aspects, the flat-topped exercise platform 40 may include a hole 120 in a duct portion. In some aspects, the hole 120 may circular. The water collected in the duct 100 may be transferred to the collection basin 110 via the hole 120. In further aspects, the height and width of the flat-topped exercise platform 40 and the stackable exercise platform 10 may correspond to the height and width of the hospital bed.

The definitions of the words or drawing elements described herein are meant to
include not only the combination of elements which are literally set forth, but all equivalent structures, materials or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in
the art, now known or later devised, are expressly contemplated as being equivalents within the scope intended and its various embodiments. Therefore, substitutions, now or later known to one with ordinary skill in the art, are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the named inventors believe that the claimed subject matter is what is intended to be patented.

What is claimed is:

1. An apparatus to assist an individual with reduced physical abilities perform light exercises and stretches, said apparatus comprising:

at least one stackable exercise platform having a superior surface and an inferior surface, a length between three and four feet, a width between two and three feet, and a thickness between two and six inches for a purpose of providing the individual with a comfortable and elevated surface on which to perform the light exercises and stretches, wherein lateral edges of said at least one stackable exercise platform are turned upwards and rounded in an ergonomic fashion forming handrails running the length of said at least one stackable exercise platform, and said superior surface and said inferior surface of said at least one stackable exercise platform are complimentary in shape allowing for secure coupling of said at least one stackable exercise platform when said at least one stackable exercise platform is placed in vertical adjacency with another said at least one stackable exercise platform, wherein each handrail is a U-shaped handrail having a first rounded portion and a second rounded portion, wherein said superior surface is connected to the first rounded portion, and said inferior surface is connected to the second rounded portion, and wherein the first rounded portion and the second rounded portion are integrated and form the U-shaped handrail.

2. The apparatus as described in claim 1 further comprising:

a shortened-length stackable exercise platform for a purpose of propping up hips of the individual while the individual is lying supine performing the light exercises and stretches on the comfortable and elevated surface of said at least one stackable exercise platform, wherein said shortened-length stackable exercise platform having a length less than half the length of said at least one stackable exercise platform, and said shortened-length stackable exercise platform having an inferior surface that is complimentary in shape to the superior surface of said at least one stackable exercise platform allowing for secure coupling of said shortened-length stackable exercise platform to said at least one stackable exercise platform when placed in vertical adjacency.

3. The apparatus as described in claim 2, wherein the shortened-length stackable exercise platform has a width same as a width of said at least one stackable exercise platform.

4. The apparatus as described in claim 2, wherein said shortened-length stackable exercise platform comprises lateral edges that are turned upwards and rounded in an ergonomic fashion forming handrails running the length of said shortened-length stackable exercise platform.

5. The apparatus as described in claim 4, wherein a shape of the handrails of said shortened-length stackable exercise platform is same as a shape of the handrails of said at least one stackable exercise platform.

6. The apparatus as described in claim 1, wherein the first rounded portion has a first portion length, and the second rounded portion has a second portion length.

7. The apparatus as described in claim 6, wherein the second portion length is greater than the first portion length.

8. The apparatus as described in claim 1, wherein the second rounded portion comprises a curve having a radius greater than a radius of the U-shaped handrail.

9. The apparatus as described in claim 8, wherein an axis of the curve is perpendicular to a longitudinal axis of the U-shaped handrail.

10. The apparatus as described in claim 1, wherein said at least one stackable exercise platform and said another said at least one stackable exercise platform have a same structure.

11. The apparatus as described in claim 1, wherein the handrails of said at least one stackable exercise platform are stacked over handrails of said another said at least one stackable exercise platform.

12. The apparatus as described in claim 11, wherein the second rounded portion of each handrail of said at least one stackable exercise platform contacts a first rounded portion of a handrail of said another said at least one stackable exercise platform.

* * * * *